US009999979B2

(12) United States Patent
Brockmann et al.

(10) Patent No.: US 9,999,979 B2
(45) Date of Patent: Jun. 19, 2018

(54) HAIR-CUTTING METHOD

(76) Inventors: Petra Brockmann, Claussnitz OT Diethensdorf (DE); Thomas Brockmann-Knodler, Claussnitz OT Diethensdorf (DE)

( * ) Notice: Subject to any disclaimer, the term of this patent is extended or adjusted under 35 U.S.C. 154(b) by 1776 days.

(21) Appl. No.: 11/400,035

(22) Filed: Apr. 7, 2006

(65) Prior Publication Data

US 2007/0102018 A1 May 10, 2007

(30) Foreign Application Priority Data

Apr. 8, 2005 (DE) ..... 10 2005 016 247

(51) Int. Cl.
*A45D 7/00* (2006.01)
*B26B 13/24* (2006.01)

(52) U.S. Cl.
CPC ..... *B26B 13/24* (2013.01); *A45D 7/00* (2013.01); *A45D 2007/007* (2013.01)

(58) Field of Classification Search
CPC ..... B26B 21/42; B26B 21/527; B26B 19/38; B26B 19/42; A45D 24/36
USPC ..... 132/200, 213.1, 214, 213
See application file for complete search history.

(56) References Cited

U.S. PATENT DOCUMENTS 4,383,374 A * 5/1983 Bertero ..... 33/373
5,232,000 A 8/1993 Chiavaras et al.
5,427,122 A 6/1995 Hamilton et al.
5,813,417 A * 9/1998 Rudolph ..... 132/200
5,991,918 A * 11/1999 Choate ..... 2/21
6,257,248 B1 * 7/2001 Yeh ..... 132/213

FOREIGN PATENT DOCUMENTS

EP 1036518 9/2000
EP 1 270 154 1/2003

OTHER PUBLICATIONS

Hairstyle video—How to slide cut your hair with shears. Nov. 30, 1999.*
Arlene Alpert et al, Milady's Standard Cosmetology, Jun. 5 2004, pp. 2 and 298-343.*
Milady's Standard Cosmetology 2004.*
"Gewust wie! Leitfaden fur die Ausbildung im Friseurhandwerk," English Title: Know how it works! Guidelines for the training of hair cutting, Section 4.1.2 through Section 6, Germany, Available as early as 1999, 3 pages. (Submitted wiht English Language Summary).

* cited by examiner

*Primary Examiner* — Rachel Steitz
(74) *Attorney, Agent, or Firm* — McCoy Russell LLP

(57) ABSTRACT

A method for the cutting of hair, in particular for the cutting of human head hair, wherein a slice of hair is taken up and is guided by a hand, namely the guide hand, with the slice of hair being pinched between two fingers, namely the guide fingers of the guide hand, and wherein the slice of hair is cut along the guide fingers using a cutting device that is actuated by another hand, namely the cutting hand. The guide hand is moved continuously or step-wise after the taking up of the slice of hair and the cutting of the slice of hair takes place at least partially during the movement of the guide hand or, in the case of step-wise movement, during and/or between the movement steps.

17 Claims, 9 Drawing Sheets

HAIR-CUTTING METHOD

CROSS REFERENCE TO RELATED APPLICATION

This application claims priority to German Patent Application Serial No. 10 2005 016 247.9 filed Apr. 8, 2005, which is hereby incorporated by reference in its entirety for all purposes.

FIELD

The present disclosure relates to a method for the cutting of hair, in particular for the cutting of human head hair. In the generic method, the hair to be cut is taken up in the form of slices of hair or "hair passees" and is held or guided by a hand which is called a guide hand in the following. For this purpose, the slice of hair is pinched between two fingers of the guide hand which are called guide fingers in the following. The slice of hair held in this manner is cut with a cutting tool along the guide fingers in the generic method. In this process, the cutting tool is actuated or operated by another hand which is called the cutting hand in the following.

BACKGROUND AND SUMMARY

Hair-cutting methods of this type are previously known in particular for the cutting of human head hair and form part of the standard repertory of an experienced hairdresser. In hair-cutting methods of this type, the hairdresser takes up slices of hair, so-called hair passees, aligned in a linear or elongate orientation with a comb and pinches them between two fingers of the guide hand. The slice of hair is usually pinched between the index finger and the middle finger of the guide hand. The guide hand and the guide fingers are held substantially straight in the previously known methods and are aligned such that the slice of hair pinched between the guide fingers substantially appears as a flat, planar slice of hair. The hair is held substantially perpendicular to the extent of the scalp in the region of the roots of the hair such that the slice of hair forms a substantially perpendicular plane on the scalp.

The slice of hair held in this manner is cut along the guide fingers in the previously known methods. It is a substantial feature of the previously known methods that the guide hand and the guide fingers are not moved during cutting, but are held in position as rigidly as possible. If the slice of hair is again aligned in the same manner as in the previous cutting after the carrying out of a cut of this manner, the hair-ends of the slice of hair form a line—called the cutting line in the following—which is substantially straight. It can be achieved with this cutting technique that the strands of hair of a slice of hair are cut substantially to the same length. If part of an already cut slice of hair is additionally taken up with the slice of hair to be cut, the strands of hair of the slice of hair to be cut can thus be cut to the same length as the previously cut slice of hair.

The previously known method for the cutting of hair is illustrated in FIGS. 1 and 2. As shown in FIG. 1, the guide fingers between which the slice of hair is pinched are held rigidly and in position during the cutting of the slice of hair and cutting takes place along the guide finger aligned substantially straight. The cutting line formed by the hair-ends of the cut slice of hair is thereby substantially straight, as can be seen in FIG. 2.

The previously known method has the disadvantage that no curved cutting lines can be cut. However, the straight cutting lines have disadvantages. It has in particular been found that the hair-cut grows out within four to six weeks with straight cutting lines. In addition, the straight cutting lines only permit the creation of the geometrical hairstyle shape. The frequently desired build-up of hairstyle volume must be produced regularly in a second workstep by recutting, for example in the techniques blending, twist cut, point cut or slice cut.

It is therefore the object of the present disclosure to propose an improved hair-cutting method. The improved hair-cutting method should be characterized inter alia in that it does not have the disadvantages known from the prior art. A hair-cutting method should in particular be proposed which permits curved cutting lines also to be produced in the cutting of slices of hair.

The object is satisfied in accordance with the present disclosure in that the guide hand is moved continuously or step-wise after the taking up or pinching of the slice of hair to be cut. The slice of hair is cut at least partially during this movement of the guide hand. If the guide hand is moved step-wise, this cutting of the slice of hair can take place during and/or between the movement steps.

On the movement of the guide hand in accordance with the present disclosure, the strands of hair of the pinched slice of hair are held slightly under strain or tension at least at times. At the same time, it is permitted at least at times that the strands of hair slide between the guide fingers to provide space for the movement of the guide hand. A sliding through of this type effects an extension of the section of hair between the roots of the hair and the guide fingers. The movement of the guide hand can comprise an angling, turning, turning in, rolling and/or bending of the guide hand and/or of the guide fingers and/or a translatory movement of the guide hand, for example by raising the arm. Depending on the type of movement selected, strands of hair of different length slide through at different positions of the guide fingers. If cutting is carried out along the guide fingers during or after the movement of the guide hand, a cutting line arises which is characterized by the preceding movement of the guide hand and the sliding through of hair caused by the preceding movement. The movement of the guide hand can preferably be matched to the time development of the cutting of the slice of hair such that the hair-ends of the cut slice of hair form a predetermined desired cutting line, with this preferably being a curved cutting line.

The advantages in accordance with the present disclosure are achieved in this manner. Slices of hair can be cut using the hair-cutting method in accordance with the present disclosure such that the strands of hair of the cut slice of hair have different lengths. In particular curved cutting lines can also be produced.

This results in the further advantage that a geometrical hair cut and volume build-up can be combined in one workstep. An enlarging of the hairstyle volume can be achieved in that adjacent strands of hair or strands of hair lying close to each other are cut to different lengths. This is usually realized in already known hair-cutting techniques in that the geometrical hair cut is reworked correspondingly in a second workstep, for example using the techniques blending, twist cut, slice cut or point cut. The method in accordance with the present disclosure allows the cutting of adjacent strands of hair or strands of hair lying close to each other to different lengths by the production of curved cutting lines inside one slice of hair. The workstep of the geometrical shape cut can thereby be combined with the volume build-up. This brings along the advantage of a more efficient hair cutting.

The hair-cutting method in accordance with the present disclosure brings along the further advantage by the variable shaping of cutting lines that layered styles and gradations can be worked directly into the hairdo in the single workstep. The design of the cutting line of the slice of hair in accordance with the method of the present disclosure moreover allows larger slices of hair to be cut. Whereas with already known hair-cutting methods the hair has to be cut in slices of a length of approximately 2 cm, the method in accordance with the present disclosure permits the cut to be cut in slices of up to 10 cm in length with the same shape result. The method in accordance with the present disclosure also permits a more efficient cutting of the hair due to the aforesaid aspects.

Finally, a haircut can be produced using the hair-cutting method in accordance with the present disclosure which grows out less fast than haircuts produced according to already known haircuts. Whereas haircuts produced in accordance with the already known methods grow out in approximately four to six weeks, it can be achieved with the method in accordance with the invention that the growing out of the haircut only occurs after up to twelve weeks. This effect is achieved in that the haircut is built up locally from different hair lengths so that the haircut is displaced less fast on natural hair growth. The locally different hair lengths, formed by underlengths or intermediate lengths of adjacent strands of hair or of strands of hair lying close to each other, which can be produced in one workstep in accordance with the hair-cutting method of the present disclosure, therefore simultaneously permit volume build-up and a delay in the growing out of the haircut.

In preferred aspects of the method in accordance with the present disclosure, the movement of the guide hand after the taking up or after the pinching of the slice of hair comprises individual movements or combinations or superimpositions of the movements carried out in the following. These movements can inter alia be carried out by an angling or turning of the guide hand at the wrist, an angling of the guide fingers at the knuckle joint, a bending of the guide fingers in the finger joints or by a translatory movement of the guide hand, for example by moving the arm associated with the guide hand, which is termed the guide arm in the following. In a preferred embodiment of the method, the movement of the guide hand after the taking up or after the pinching of the slice of hair can comprise an angling of the wrist. The wrist is preferably angled inwardly, that is such that the angle between the palm of the hand and the lower arm reduces. Furthermore, the movement of the guide hand can comprise a turning of the guide hand, in particular at the wrist. Another possible movement is the removal of the guide hand from the roots of the hair, in particular by a suitable movement of the guide arm. Furthermore, the movement of the guide hand can comprise an angling of the guide fingers at the knuckle joint, in particular such that the angle between the guide fingers and the palm of the hand reduces. The movement of the guide hand can also comprise a bending of the guide fingers, preferably at the finger joints, in particular such that this bending represents a rolling in of the guide hand in combination with the angling of the guide fingers at the finger joints and/or with the angling of the guide hand at the wrist. Moreover, the movement of the guide hand can comprise a pivoting of the guide fingers with respect to the alignment on the taking up or pinching of the slice of hair, preferably such that the line formed by the guide fingers is out of square with respect to the line of the roots of hair of the slice of hair taken up. With this type of movement, the cutting of the slice of hair is preferably started after the guide fingers have been pivoted by approximately 90° with respect to the alignment on the taking up of the slice of hair and/or with respect to the lines formed by the roots of hair of the slice of hair.

The movement of the guide hand after the taking up and/or pinching of the slice of hair advantageously comprises a movement by which the finger knuckles of the guide fingers move further away from the roots of the hair of the pinched hairs than the tips of the guide fingers. Due to the sliding through of the strands of hair on this movement, longer strands of hair slip between the guide fingers in the proximity of the finger knuckle than in the proximity of the tips of the guide fingers. After a movement of this type, the cutting along the guide fingers then leads to the result that the strands of hair of the slice of hair are cut to different lengths.

The movement of the guide hand can moreover also comprise a movement by which the side of the guide fingers initially remote from the roots of the hair comes to face the roots of the hair in the course of the movement. In particular when the outer side of the guide fingers, i.e. the side on which the fingernails are located, is remote from the roots of the hair on the taking up and/or pinching of the slice of hair, the movement can be made such that the outer side of the guide fingers is moved to face the roots of the hair. This embodiment of the method permits the slice of hair to be laid at least partly around one of the fingers in the course of the movement so that the sliding through of the slice of hair can be controlled better by the guide fingers.

In a further possible aspect, the movement of the guide hand comprises a movement by which the slice of hair is rotated in a spiral manner.

In a further preferred embodiment of the method in accordance with the present disclosure, the movement of the guide hand comprises the steps listed below after the taking up of the slice of hair: The slice of hair is first pinched between the guide fingers with the wrist substantially extended and the guide fingers substantially extended, with the line formed by the hand and the guide fingers preferably being aligned substantially parallel to the line of the roots of the hair. In a following step, the hand is angled at the wrist and the guide fingers are angled at the knuckle joint until the lower arm of the guide arm and the guide fingers include an angle of approximately 90° or more than 90°. In a further step, the angling of the wrist and the angling of the guide fingers are continued at the knuckle joint. In addition, in this step, the guide fingers are curved at the finger joints so that the movement is similar or alike to a rolling in of the guide hand overall. The movement is continued in this step at least so far until the last member of the finger of the guide fingers extends substantially parallel to the lower arm of the guide arm and faces in the direction of the elbow of the guide arm. During the movement step last described, the slice of hair is cut, with the cutting preferably starting at the tips of the finger and cutting taking place up to the finger knuckles.

Scissors are preferably used to cut the slice of hair. It is advantageous to cut the slice of hair in a plurality of individual, in particular fairly small, cuts of the scissors. Approximately 0.5 to 1 cm is preferably cut off the length of the slice of hair in a single one of the plurality of cuts of the scissors.

An embodiment of the method in accordance with the present disclosure is explained in detail with reference to FIGS. 1 to 8.

DETAILED DESCRIPTION

Figure 1:
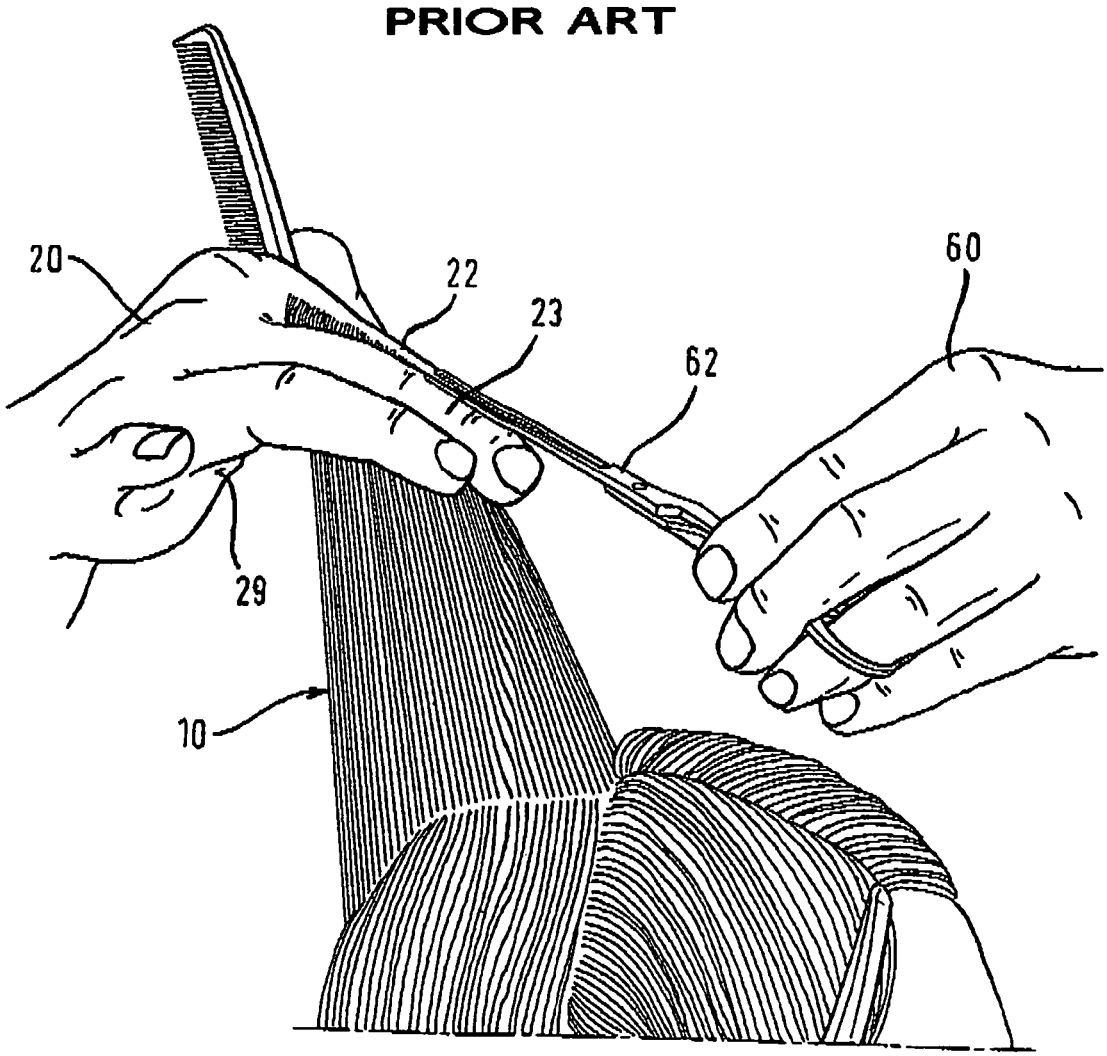
Fig. 1 PRIOR ART
FIG. 1 shows cutting of a slice of hair 10 in accordance with the already known hair-cutting method.
Figure 2:
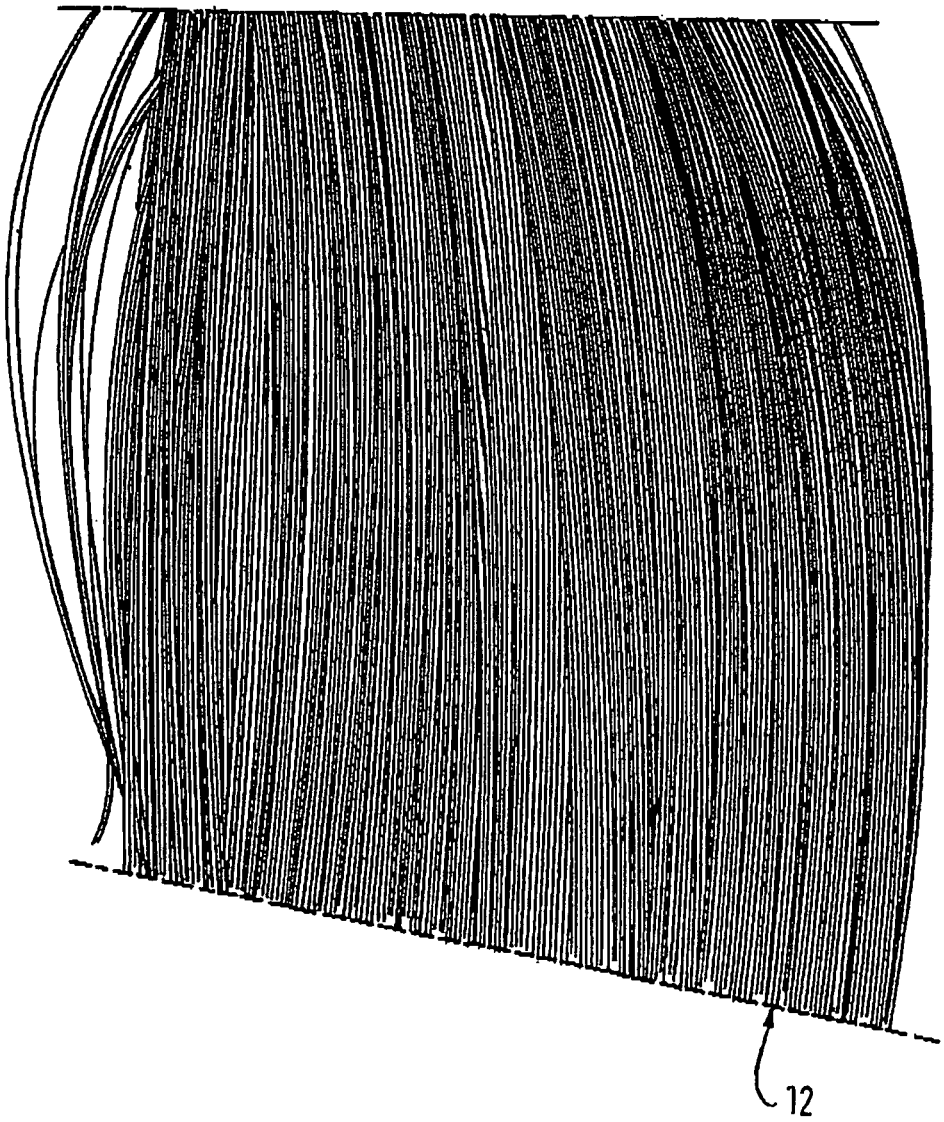
Fig. 2 PRIOR ART
FIG. 2 shows the cutting line 12 after the cutting of a slice of hair 10 in accordance with the already known hair-cutting method.

FIG. 1 shows the cutting of a slice of hair 10 in accordance with the already known method. The guide fingers 22, 23 between which the slice of hair 10 is pinched are held rigidly and substantially straight during the cutting of the slice of hair 10. The slice of hair 10 is cut off in a straight line with the scissors 62 along the guide fingers 22, 23 so that the cut image shown in FIG. 2 is created with a substantially straight cutting line 12.

FIGS. 3 to 7 show by way of example in a sequence of images the course of the cutting of a slice of hair 10 in accordance with the method of the present disclosure.

Figure 3:
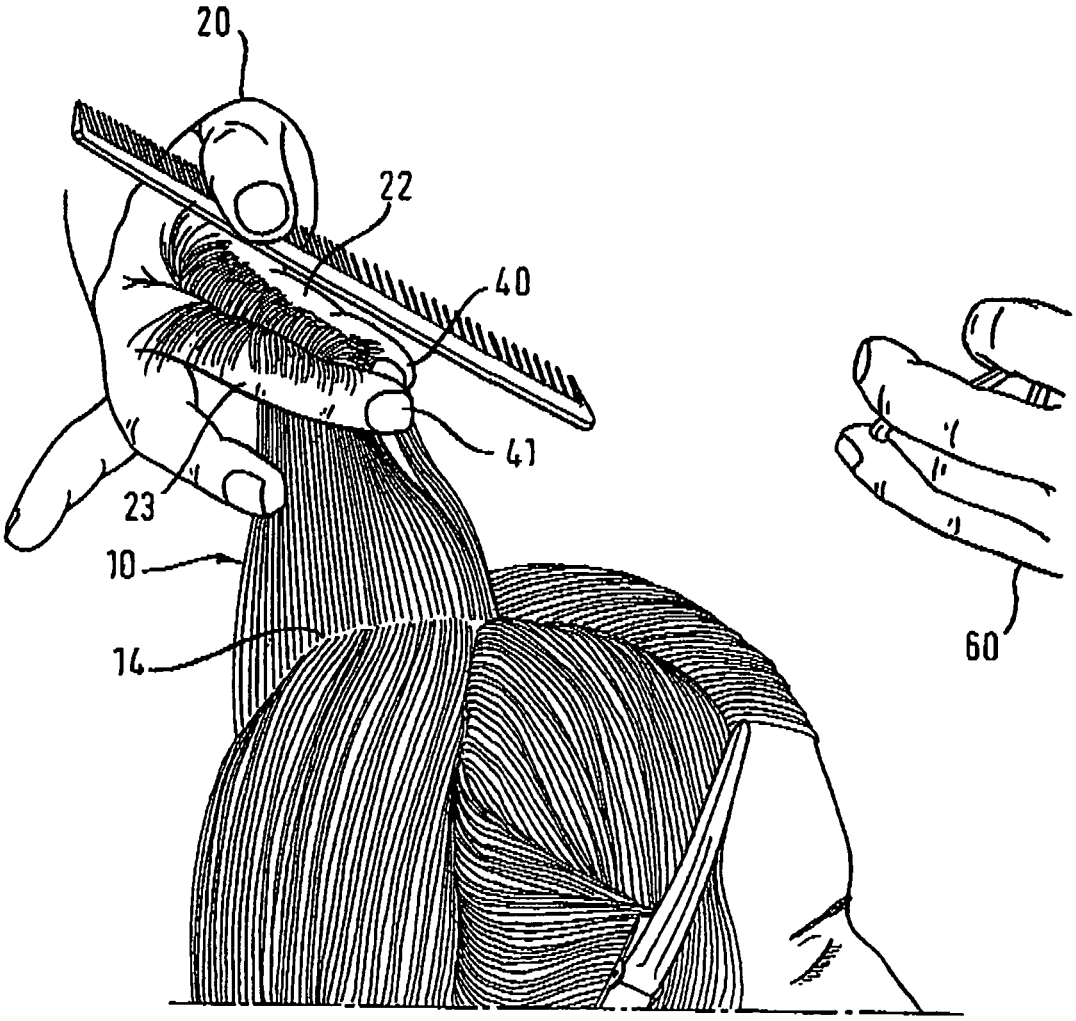
FIGS. 3 to 7 show an image sequence on the course of the cutting of a slice of hair 10 in accordance with the method of the present disclosure.

As shown in FIG. 3, the slice of hair 10 is pinched between the index finger 22 and the middle finger 23 of the guide hand 20. The guide fingers 22, 23 are only slightly angled at the knuckle joint 26, 27 and are substantially extended at the finger joints 30, 31, 32, 33. The slice of hair 10 taken up substantially forms a planar surface which is formed by the pinching line between the guide fingers 22, 23 and the line of the roots of the hair 14 of the slice of hair 10 taken up.

Figure 4:
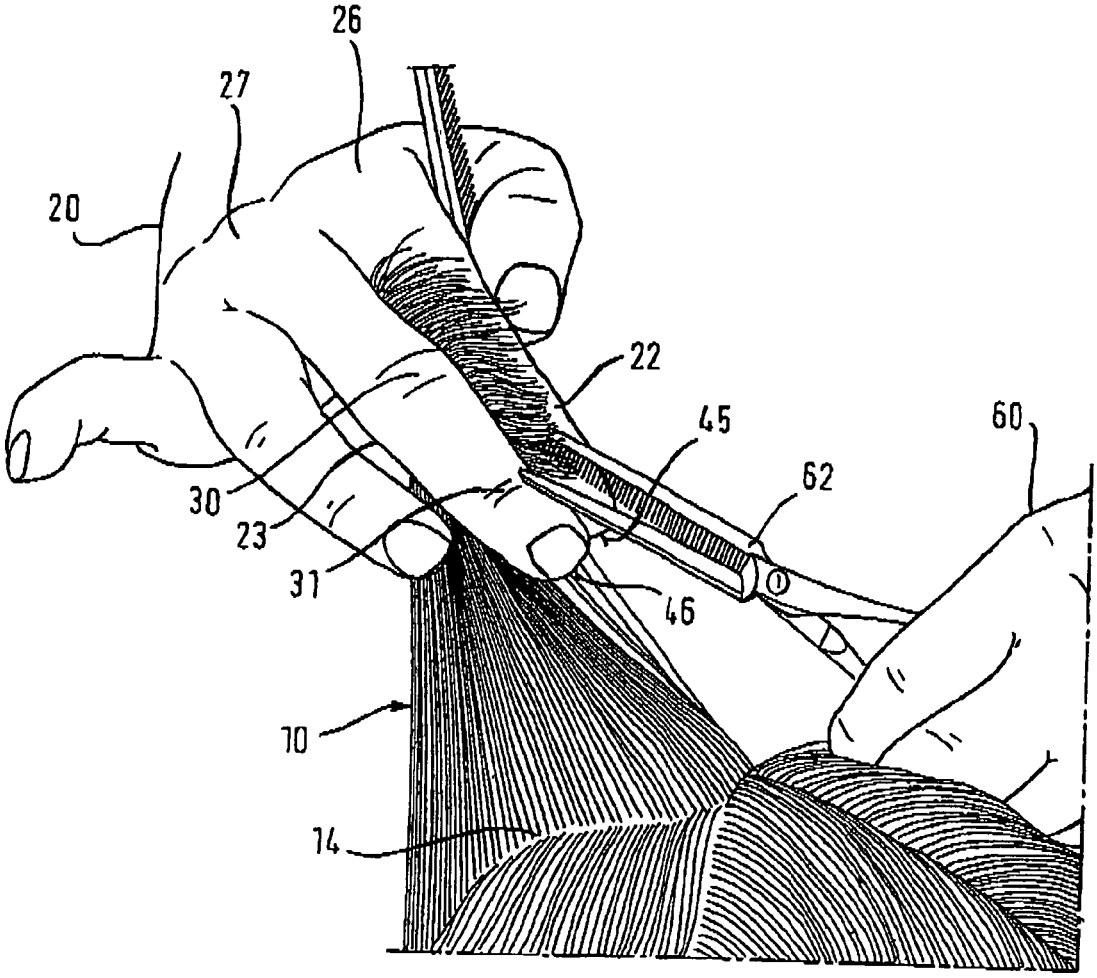

After the taking up of the slice of hair 10, a movement takes place into the position shown in FIG. 4. For this purpose, the guide fingers 22, 23 are angled at the knuckle joint 26, 27. At the same time, the guide hand 20 is rotated such that the palm of the hand 29 of the guide hand 20 approaches a position which is substantially parallel to that region of the scalp in which the roots of the hair 14 of the slice of hair 10 taken up are located. In this movement, the slice of hair 10 is rotated by about 90° in a spiral manner so that it no longer forms a planar surface. At the same time, the pinching line formed by the guide fingers 22, 23 moves into a position out of square with respect to the line of the roots of hair 14 of the slice of hair 10 taken up. On this movement, the strands of hair of the slice of hair 10 taken up are held lightly under tension and a controlled sliding through of strands of hair between the guide fingers 22, 23 is permitted.

When the guide fingers 22, 23 are angled more than approximately 60° at the knuckle joint 26, 27, as can be seen in FIG. 4, cutting of the slice of hair 10 is started from the tips 45, 46 of the guide fingers. In the position shown in FIG. 4, the slice of hair 10 is partly laid around the middle finger 23 of the guide hand 20. The sliding through of the slice of hair 10 between the guide fingers 22, 23 can thereby be controlled better.

Figure 5:
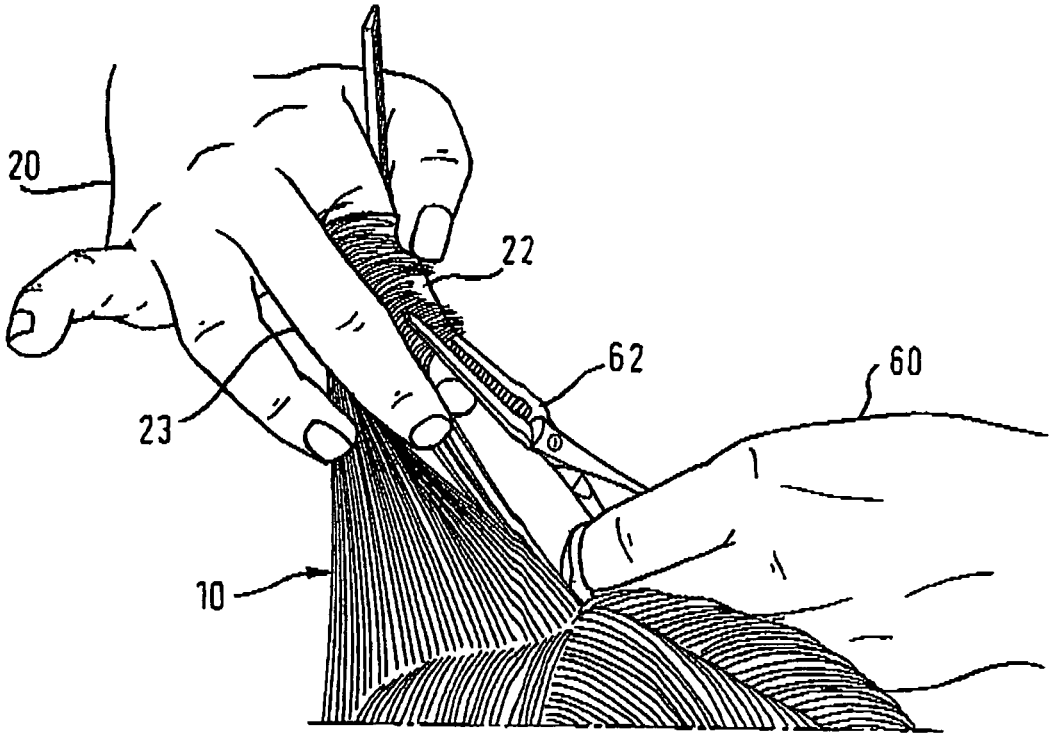
Figure 6:
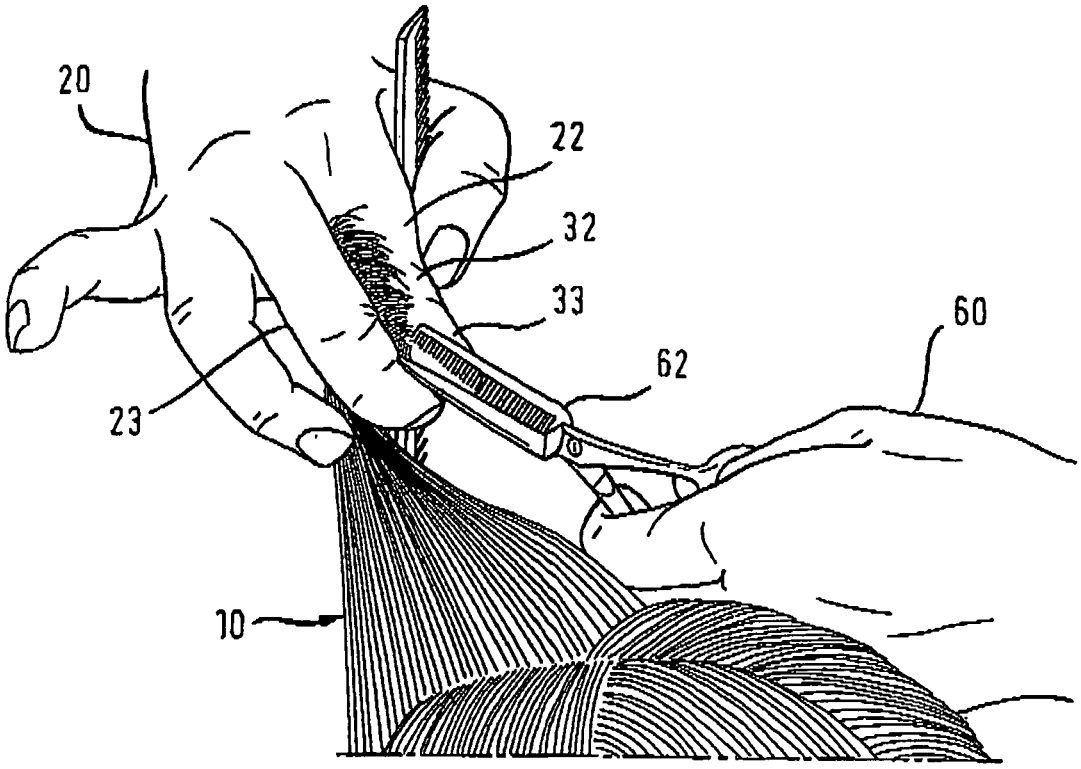
Figure 7:
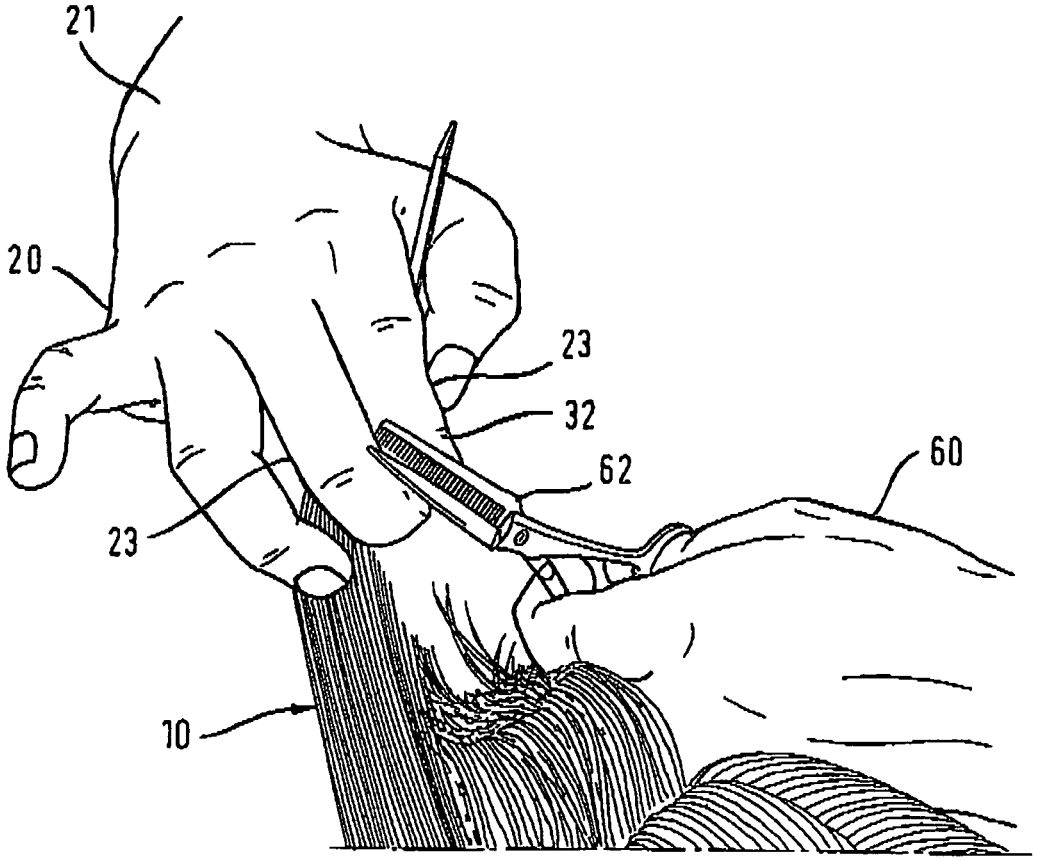

As can be seen in FIGS. 5 to 7, the guide fingers 22, 23 are further angled on the further cutting of the slice of hair 10 at the knuckle joint 26, 27 and at the finger joints 30, 31, 32, 33. The slice of hair 10 is continued to be held under tension during this angling. It is permitted in this process that the strands of hair pinched between the guide fingers 22, 23 slowly slide through further. In this process, longer sections of hair of the slice of hair 10 can slide between the guide fingers 22, 23 in greater proximity to the finger knuckles 26, 27. The slice of hair 10 is continued to be cut step-wise, as can be seen in FIGS. 5 to 7, during the previously described movement of the guide hand 20. As can be seen from FIG. 7, the cutting of the slice of hair 10 and the angling of the guide fingers 22, 23 are matched to one another such that the cutting of the slice of hair 10 is ended when the last member 40, 41 of the guide fingers 22, 23 is aligned substantially parallel to the lower arm 21 of the guide arm and faces in the direction of the elbow of the guide arm.

Figure 8:
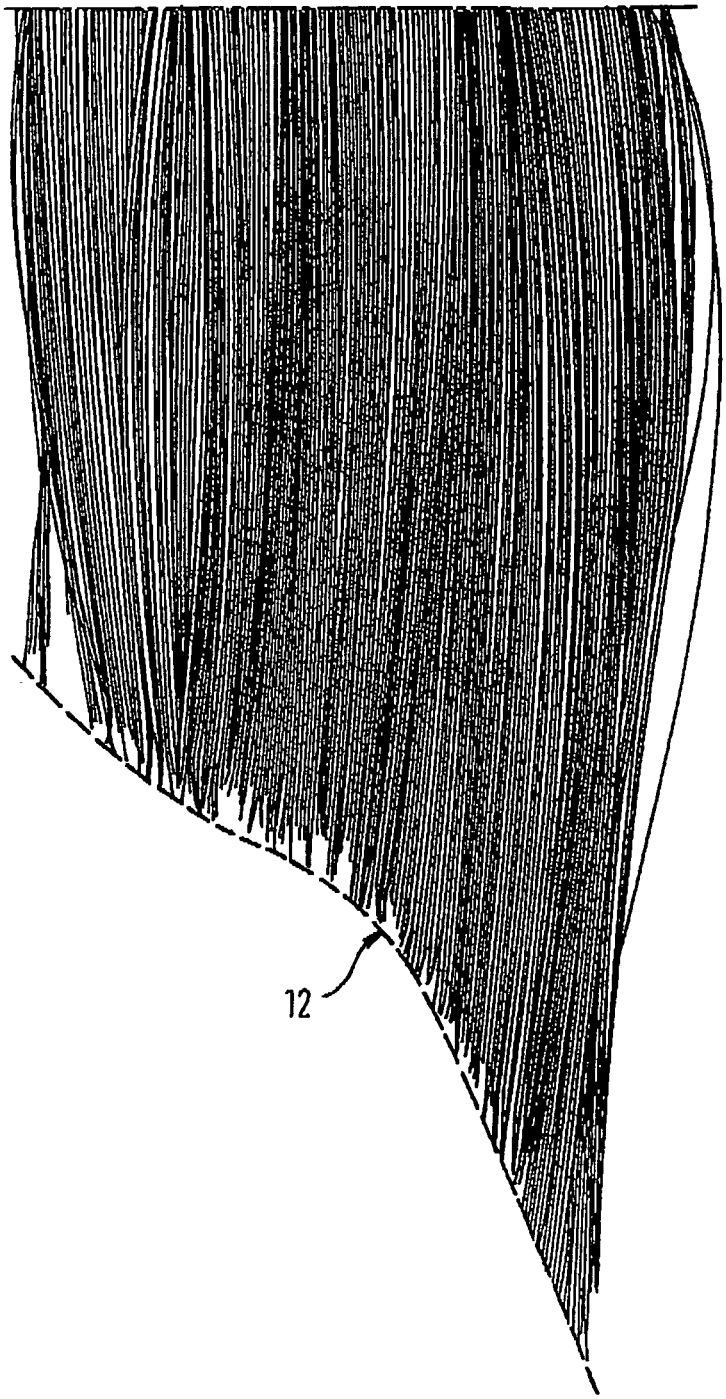
FIG. 8 shows a cutting line 12 after the cutting of a slice of hair 10 in accordance with the present disclosure.

The cutting line 12 shown in FIG. 8 can be produced using the course of the cutting of a slice of hair 10 shown in FIGS. 3 to 7. FIG. 8 in particular illustrates that a curved cutting line 12 can be produced using the hair-cutting method in accordance with the present disclosure.

Figure 9:
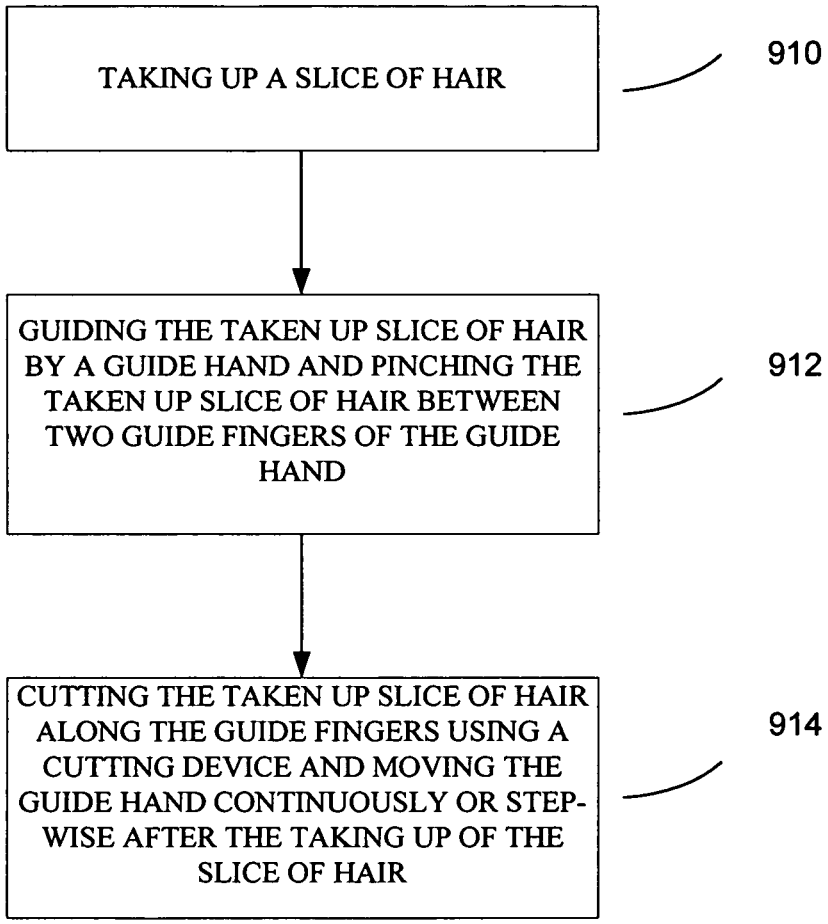
FIG. 9 shows an example flowchart for cutting human head hair.

Referring now to FIG. 9, an example flow chart is provided illustrating one example approach for cutting hair as noted above herein. Specifically, in one example, the method for the cutting of human head hair includes: taking up a slice of hair at 910, guiding the taken up slice of hair by a guide hand and pinching the taken up slice of hair between two guide fingers of the guide hand at 912, cutting the taken up slice of hair along the guide fingers using a cutting device that is actuated by another cutting hand and moving the guide hand continuously or step-wise at 914 after the taking up of the slice of hair; wherein the cutting of the slice of hair takes place at least partially during the movement of the guide hand or, in the case of step-wise movement, during and/or between the movement steps at 914.

In addition, any of the additional steps or modifications noted herein may be used in the flowchart of FIG. 9.

The invention claimed is:

1. A method for the cutting of hair wherein a slice of hair is taken up and is guided by a hand, namely the guide hand, with the slice of hair being pinched between two fingers, namely the guide fingers of the guide hand, and wherein the slice of hair is cut along the guide fingers using a cutting device that is actuated by another hand, namely the cutting hand, wherein the guide hand is moved continuously or step-wise after the taking up of the slice of hair, wherein a sliding of strands of hair of the slice of hair between the guide fingers is permitted to provide space for the movement of the guide hand, wherein the cutting of the slice of hair takes place at least partially during the movement of the guide hand, wherein the movement of the guide hand comprises a movement after the taking up of the slice of hair by which the slice of hair is rotated in a spiral manner, wherein the movement of the guide hand further comprises a pivoting of the guide fingers, with respect to the alignment of the guide fingers on taking up of the slice of hair, after the taking up of the slice of hair, and wherein the cutting of the slice of hair starts after the guide fingers have pivoted by approximately 90°.

2. The method according to claim 1, wherein the hair being cut comprises human head hair, and wherein the guide hand is moved continuously and the cutting of the slice of hair takes place at least partially during the continuous movement, and wherein the cutting at least partially during the continuous movement combines a geometrical hair cut and volume build-up in one workstep.

3. The method according to claim 1, wherein the movement of the guide hand and the cutting of the slice of hair are matched to one another such that the ends of the hair of the cut slice of hair form a specific curved cutting line.

4. The method according to claim 1, wherein the movement of the guide hand comprises an inward angling of a wrist of the guide hand after the taking up of the slice of hair.

5. The method according to claim 1, wherein the movement of the guide hand comprises a rotation of the guide hand at the wrist after the taking up of the slice of hair.

6. The method according to claim 1, wherein the movement of the guide hand comprises a removal of the guide hand from the roots of the hair, after the taking up of the slice of hair.

7. The method according to claim 1, wherein the movement of the guide hand comprises the angling of the guide fingers at the knuckle joint, after the taking up of the slice of hair.

8. The method according to claim 1, wherein the movement of the guide hand comprises a movement after the taking up of the slice of hair by which the finger knuckles of the guide fingers move further away from the roots of hair of the strands of hair of the slice of hair than the tips of the guide fingers.

9. The method according to claim 1, wherein the movement of the guide hand comprises a movement after the taking up of the slice of hair by which the outer side of the guide fingers initially remote from the roots of hair comes to face the roots of the hair in the course of the movement of the guide hand.

10. The method according to claim 1, wherein the movement of the guide hand comprises the following steps after the taking up of the slice of hair:

(a) pinching of the slice of hair between the guide fingers with a substantially extended wrist and substantially extended guide fingers;

(b) angling of the guide hand at the wrist and of the guide fingers at the knuckle joint until a lower arm and the guide fingers include an angle of more than 90°;

(c) a further rolling in of the guide hand by a further angling of the wrist, a further angling of the guide fingers at the knuckle joint and a bending of the guide fingers at the finger joints until the last member of the finger extends substantially parallel to the lower arm and faces in the direction of the elbow of the guide arm, wherein the cutting of the slice of hair takes place during step c), starting from the fingertips toward the finger knuckles.

11. The method according to claim 1, wherein scissors are used to cut the slice of hair, and wherein a first plurality of strands of hair of the pinched slice of hair are held slightly under strain or tension while a second plurality of strands of hair slide between the guide fingers to provide space for the movement of the guide hand.

12. The method according to claim 11, wherein the cutting of the slice of hair is carried out in a plurality of individual cuts of the scissors.

13. The method according to claim 12, wherein approximately 0.5 to 1 cm is cut from the length of the slice of hair per cut of the plurality of individual cuts of the scissors.

14. A method for the cutting of human head hair, comprising:

taking up a slice of hair;

guiding the taken up slice of hair by a guide hand;

pinching the taken up slice of hair between two guide fingers of the guide hand;

cutting the taken up slice of hair along the guide fingers using a cutting device that is actuated by another cutting hand; and moving the guide hand continuously or step-wise after the taking up of the slice of hair, wherein a sliding of strands of hair of the slice of hair between the guide fingers is permitted to provide space for the movement of the guide hand, wherein the cutting of the slice of hair takes place at least partially during the movement of the guide hand, wherein the movement of the guide hand comprises a movement after the taking up of the slice of hair by which the slice of hair is rotated in a spiral manner, wherein the movement of the guide hand further comprises a pivoting of the guide fingers, with respect to the alignment of the guide fingers on taking up of the slice of hair, after the taking up of the slice of hair, and wherein the cutting of the slice of hair starts after the guide fingers have pivoted by approximately 90°.

15. The method according to claim 14, wherein the movement of the guide hand and the cutting of the slice of hair are matched to one another such that the ends of the hair of the cut slice of hair form a specific cutting line, wherein the specific cutting line comprises a curved cutting line, and wherein the movement of the guide hand comprises an angling of a wrist of the guide hand after the taking up of the slice of hair, wherein the angling of the wrist is inward.

16. The method according to claim 15, wherein the movement of the guide hand comprises the following steps after the taking up of the slice of hair:

(a) pinching of the slice of hair between the guide fingers with a substantially extended wrist and substantially extended guide fingers;

(b) angling of the guide hand at the wrist and of the guide fingers at the knuckle joint until a lower arm and the guide fingers include an angle of more than 90°;

(c) a further rolling in of the guide hand by a further angling of the wrist, a further angling of the guide fingers at the knuckle joint and a bending of the guide fingers at the finger joints until the last member of the finger extends substantially parallel to the lower arm and faces in the direction of the elbow of the guide arm, wherein the cutting of the slice of hair takes place during step c), starting from the fingertips toward the finger knuckles.

17. The method according to claim 14, wherein the movement of the guide hand comprises a rotation of the guide hand at the wrist after the taking up of the slice of hair, and further wherein the guide hand is moved continuously after the taking up of the slice of hair.

* * * * *